US008136179B2

(12) United States Patent
Li et al.

(10) Patent No.: US 8,136,179 B2
(45) Date of Patent: Mar. 20, 2012

(54) POP-UP DRAIN STOPPER LINKAGE ASSEMBLY

(75) Inventors: Chun-Hung Li, Taichung (TW); Wei-Mien Hsu, Taichung (TW); Yongjun Wu, Shenzhen (CN)

(73) Assignee: Globe Union Industrial Corp., Taichung County (TW)

( * ) Notice: Subject to any disclaimer, the term of this patent is extended or adjusted under 35 U.S.C. 154(b) by 727 days.

(21) Appl. No.: 12/201,864

(22) Filed: Aug. 29, 2008

(65) Prior Publication Data

US 2010/0050337 A1 Mar. 4, 2010

(51) Int. Cl.
*E03C 1/244* (2006.01)

(52) U.S. Cl. ..... 4/689; 4/690; 4/691

(58) Field of Classification Search ..... 4/684, 689–692; 24/614, 662, DIG. 43, 298, 302; 403/326, 403/329

See application file for complete search history.

(56) References Cited

U.S. PATENT DOCUMENTS

| | | | | |
|---|---|---|---|---|
| 1,958,992 | A * | 5/1934 | Fraser | 4/692 |
| 2,455,236 | A * | 11/1948 | Darvie et al. | 24/522 |
| 4,192,026 | A * | 3/1980 | Williams | 4/692 |
| 4,903,943 | A | 2/1990 | Hochstrasser | |
| 6,061,847 | A | 5/2000 | Jourdan | |
| 6,824,180 | B2 * | 11/2004 | Tomchak | 294/57 |

* cited by examiner

*Primary Examiner* — Gregory Huson
*Assistant Examiner* — Janie Christiansen

(57) ABSTRACT

A pop-up drain stopper linkage assembly includes a lift rod, a connecting bar, a pivot rod and a drain stopper. The bottom end of the lift rod forms an engagement part. The upper end of the connecting bar has an engagement groove for the engagement part of the lift rod being engaged and fixed, and the connecting bar has a plurality of holes spaced apart a distance away from the engagement groove. The second end of the pivot rod connects to the drain stopper and a section adjacent the first end has a plurality of fixed portions for tying in with the hole of the connecting bar, and each of the fixed portions and any one of the holes are capable of being passing through and positioning with each other. Thereby, the pop-up drain stopper linkage assembly can be quickly and conveniently assembled with reliable linking effect.

2 Claims, 3 Drawing Sheets

POP-UP DRAIN STOPPER LINKAGE ASSEMBLY

BACKGROUND OF THE INVENTION

1. Field of Invention

The present invention relates to a linkage assembly, and more particularly to a pop-up drain stopper linkage assembly which is easy to be quickly assembled and capable of linking reliably.

2. Related Art

Generally, the washbasin used in most family has a lift rod extended downward from the faucet housing, which the lift rod connects to a pivot rod and the pivot rod connects to the pop-up drain stopper, the pop-up drain stopper can then be driven to open or close by pulling the lift rod up and down, so as to save the water in the washbasin or move the water out from the washbasin.

The pivot rod mentioned above usually fixes with a spherical body, which the spherical body is pivoted in the drain base. The pivot rod can act a lever motion based on the spherical body as a pivot point, so as to drive the pop-up drain stopper move up or down and further to achieve the operation of open or close. More specific, the pivot rod is pivoted in the drain base by the spherical body, wherein one end of the pivot rod adjacent the spherical body connects to the pop-up drain stopper and the other end of the pivot rod away from the spherical body connects to the above-mentioned lift rod. The U.S. Pat. No. 4,903,943 has disclosed such structure.

In this structure, the lift rod moves up or down in its longitudinal direction and the pivot rod pivots based on the spherical body as the pivot point. Therefore, a connecter with two terminations capable of being rotated comparatively is set between the lift rod and the pivot rod. The two terminations of the connecter provide the lift rod and the pivot rod passing through and then uses the screw to fix, therefore, when the lift rod moves up or down in its longitudinal direction, it can force the pivot rod oscillate accordingly.

However, the above-mentioned structure is not easy for assembling because this kind of structure is normally set up in the narrow and small spaces under the washbasin. To assemble the lift rod, the pivot rod and the connector in such small spaces, and to lock the bolt of the connector by the screwdrivers, such works are arduous and time-consuming.

Moreover, the bolt of the above-mentioned connector may become loose after using over a long period of time, and it makes the lift rod unable to work with the pivot rod to drive the pop-up drain stopper to open or close successfully, so as to form the using problems. Or, the rusty formed between the connector and the blot after using a period of time makes them unable of dismount and cause the puzzlement while changing relevant parts in the future.

In order to solve these problems, some new structure has been designed accordingly, such as the structure disclosed in the U.S. Pat. No. 6,061,847 Please referring to FIG. 3, an actuating stem 81 and a connecting bar 82 are used to replace the afore-said lift rod, and the connecting bar 82 linked with the pivot rod 83 is used to force the pop-up drain stopper 84 to open or close.

The actuating stem 81 has a J-shaped portion 811 at its bottom end. A connecting bar 82 has a plurality of vertically aligned apertures 821, 822 at both ends. The J-shaped portion 811 of the stem 81 is removable received within one of the apertures 821 adjacent the upper end of the connecting bar 82. The upper end of the connecting bar 82 also includes a semi-cylindrical channel 823 to receive a portion of the stem 81. The pivot rod 83 is received within one of the apertures 822 at the lower end of the connecting bar 82. When the stem 81 is pulled up or down, it can link to the connecting bar 82 and force the pivot rod 83 to oscillate, so as to control the pop-up drain stopper 84 to open or close.

The structure disclosed in the U.S. Pat. No. 6,061,847 has the results in quickly and conveniently adjusted or dismantled, however, the apertures 821 of the connecting bar 82 and the J-shaped portion 811 of the stem 81 is only in a hook relation, which is no definite positioning relation existed between the stem 81 and the connecting bar 82. Besides, the aperture 822 of the connecting bar 82 only used for receiving the stem 81, which is also no definite positioning relation existed between them. Therefore, when the user pulls up stem 81 forcibly, it may cause the connecting bar 82 oscillate deviating, so as to influence the movement of the pop-up drain stopper 84 when no definite positioning relation existed between the connecting bar 82, the stem 81 and the pivot rod 83. More seriously, it may cause the problem of the connecting bar 82 deviating from the pivot rod 83.

Therefore, it is necessary to improve the above-mentioned structure and provide a way which resulted in both quickly assembled and certainly linked.

SUMMARY OF THE INVENTION

The primary object of the present invention is to solve the above-mentioned issues and to provide a pop-up drain stopper linkage assembly using a lift rod, a connecting bar and a pivot rod with quickly assembled and capable of linking reliably.

The secondary object of the present invention is to provide an assembly method with multi-section adjusting along with the axial of the connecting bar and the pivot rod in the connecting position between the connecting bar and the pivot rod, provided by a plurality of holes of connecting bar together with a plurality of fixed portions of the pivot rod, to improve the assembling convenience.

For achieving the above-mentioned objects, the pop-up drain stopper linkage assembly according to the present invention includes a lift rod, a connecting bar, a pivot rod and a drain stopper. The bottom end of the lift rod forms an engagement part. The upper end of the connecting bar has an engagement groove for the engagement part of the lift rod being engaged and fixed, and the connecting bar has a plurality of holes spaced apart a distance away from the engagement groove. The second end of the pivot rod connects to the drain stopper, and a plurality of fixed portions are formed at a section adjacent the first end, wherein each of the fixed portions and any one of the holes are capable of passing through and positioning with each other.

Accordingly, the lift rod can be quickly plugged into the connecting bar for positioning, and the pivot rod can be received and fixed by the connecting bar for positioning, so as to achieve the object of quickly and conveniently assembly. Besides, the fixed portion on the pivot rod can be received and fixed within the hole of the connecting bar for positioning, so as to achieve the object of certain linkage between the lift rod, the connecting bar and the pivot rod.

Furthermore, the connecting bar has a plurality of holes and the pivot rod has a plurality of fixed portions, the hole and the fixed portion can cooperate together, which each of the fixed portions can be received and fixed within any one of the hole. Therefore, the connecting position between the connecting bar and the pivot rod position can be adjusted with multi-section along with the axial of the connecting bar and the pivot rod to improve the assembling convenience.

DETAILED DESCRIPTION OF THE INVENTION

Figure 1:
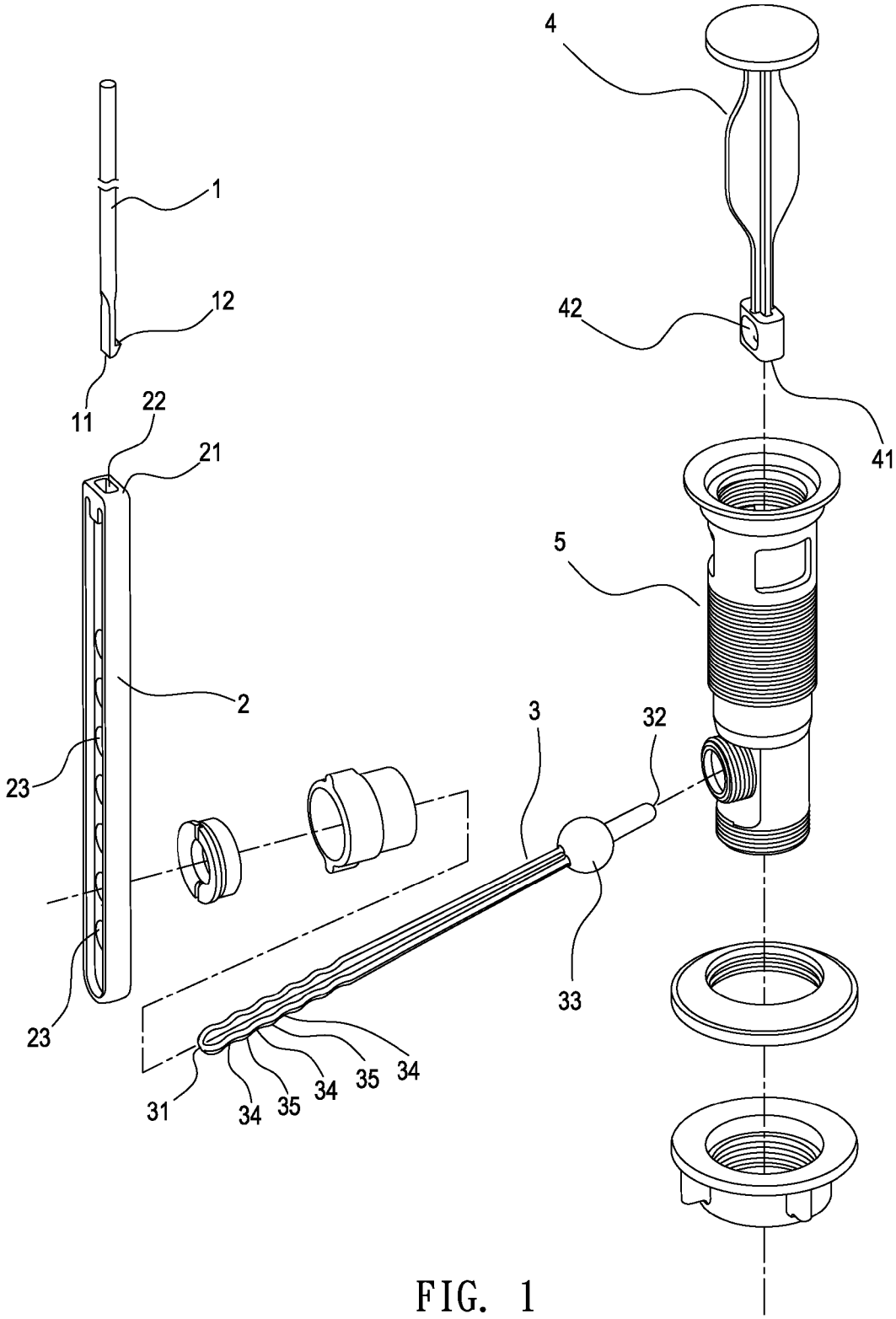
FIG. 1 is a schematic view according to the present invention.
Figure 2:
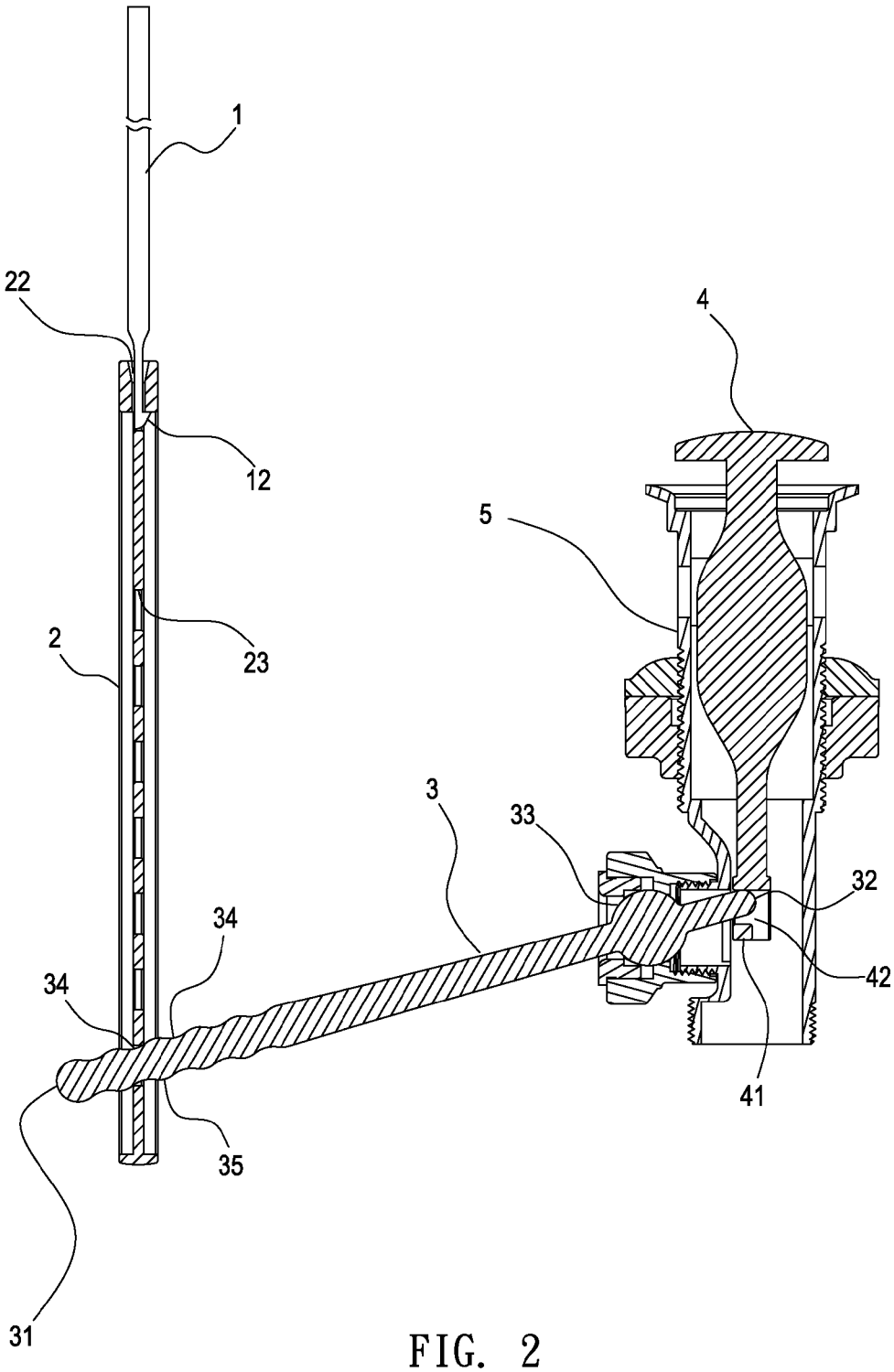
FIG. 2 is a cross-sectional view of the present invention.
Figure 3:
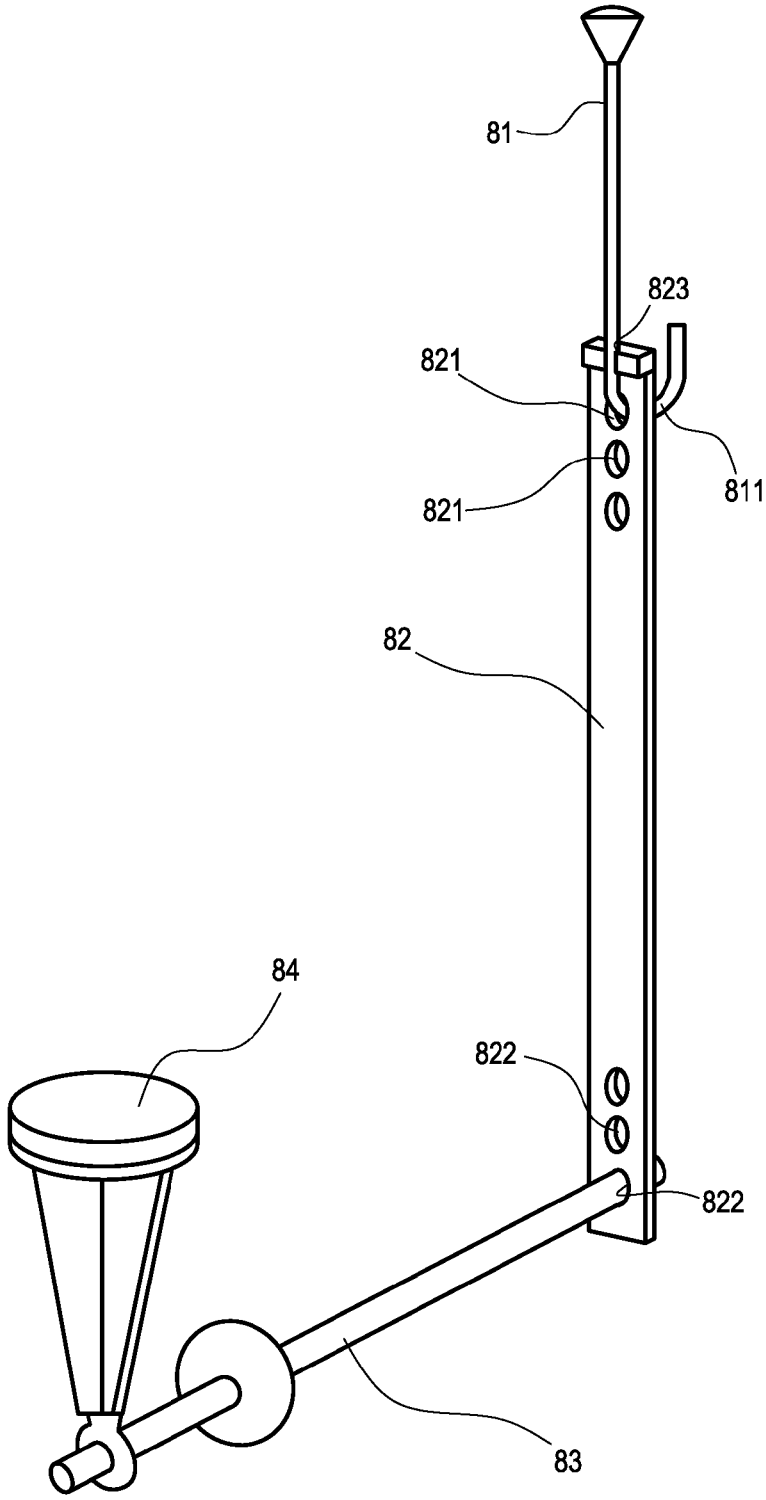
FIG. 3 (PRIOR ART)
FIG. 3 is a schematic view according to the prior art.

Refer to FIG. 1 and FIG. 2, which shows a preferred embodiment according to the present invention. FIG. 1 is a schematic view according to the present invention and FIG. 2 is a cross-sectional view of the present invention.

The pop-up drain stopper linkage assembly according to the present invention includes a lift rod 1, a connecting bar 2, a pivot rod 3 and a drain stopper 4. The pivot rod 3 and a drain stopper 4 are disposed in the drain base 5. The way to dispose the pivot rod 3 and the drain stopper 4 in the drain base 5 is well-know in the prior art, so that the disposing method will not be mentioned here.

The lift rod 1 has a bottom end 11, and the bottom end 11 forms an engagement part 12. In this embodiment, the engagement part 12 has a hook-shaped configuration and the engagement part 12 has a substantially rectangular cross-section. In practical operation, the lift rod is disposed through the faucet housing. (Un-shown in the FIG)

The connecting bar 2 has an upper end 21. The upper end 21 corresponding to the engagement part 12 of the lift rod 2 has an engagement groove 22 for engaging and fixing, and the connecting bar 2 has a plurality of holes 23 spaced apart a distance away from the engagement groove 22.

The pivot rod 3 has a first end 31 and a second end 32, and the pivot rod adjacent the second end has a spherical body 33. The pivot rod 3 is pivoted in the drain base 5 based on the spherical body 33. A section of the pivot rod 3 adjacent the first end 31 has a plurality of fixed portions 34 for tying in with the hole 23 of the connecting bar 2, and each of the fixed portions 34 being capable of being received and fixed within any one of the hole 23 for positioning. In this embodiment, in order to save the material and still keep suitable strength, the section of the pivot rod 3 adjacent the first end 31 has a cross-shaped cross-section and each of the fixed portions 34 has a concave arc structure with inward curve. Besides, a convex arc portion 35 is connected between an adjacent two said fixed portions 34. Therefore, the section of the pivot rod 3 adjacent the first end 31 appears with concave-convex arc configuration.

The drain stopper 4 has a bottom portion 41, and the bottom portion 41 has an accommodation 42 for the second end 32 of the pivot rod 3 passing therethrough.

The lift rod 1 and the connecting bar 2 of the prevent invention use the engagement part 12 with a hook-shaped configuration to plug into the engagement groove 22 and being fixed together, and the engagement part 12 has a substantially rectangular cross-section. Therefore, after the lift rod 1 attaches to the connecting bar 2, it forms a stable fixed configuration with a straight condition.

The first end 31 of the pivot rod 3 passes through the hole 23 of the connecting bar 2, and the fixed portion 34 with concave arc structure is received within the hole 12. In practical operation, an outer diameter of the section of the pivot rod 3 adjacent the first end 31 is slightly larger than or equal to an inside diameter of the holes of the connecting bar. Therefore, when the fixed portion 34 is received within the hole, it will not loose easily. Moreover, the drain stopper 4 is either in its open condition (status shown in FIG. 2), or in its close condition, it means that the pivot rod 3 will not be in its horizontal status, therefore, the fixed portion 34 with inward curve can be received within the hole 12 of the connecting bar 2 for positioning, so as to form a reliable linkage configuration between the pivot rod 3 and the connecting bar 2.

Therefore, when the users pulled up or down the lift rod 1 forcibly, it will force the connecting bar 2 move up or down, and cause the pivot rod 3 oscillate, so as to influence the movement of the pop-up drain stopper 8 in the drain base 5 to be moved up or down as the operation of open or close.

To sum up, the lift rod 1 can be quickly plugged into the connecting bar 2 for positioning, and the pivot rod 3 can be received by the connecting bar 2 for positioning, so as to assemble the whole linkage assembly quickly and conveniently. Besides, the fixed portion 34 of the pivot rod 3 can be received within any one of the hole 23 of the connecting bar 2 for positioning, therefore, it makes the lift rod 1, connecting bar 2 and the pivot rod 3 has a reliable linkage effect with multi-section adjusting, and improve the assembling convenience.

What is claimed is:

1. A pop-up drain stopper linkage assembly, comprising: a lift rod having a bottom end forming an engagement part; a connecting bar, having an upper end with an engagement groove corresponding to the engagement part of the lift rod for being engaged and fixed, and the connecting bar having a plurality of holes spaced apart a distance away from the engagement groove; a pivot rod having a first end and a second end, a section adjacent the first end has a plurality of fixed portions for tying in with the hole of the connecting bar, and each of the fixed portions and any one of the holes being capable of passing through and positioning with each other; and a drain stopper having a bottom portion connecting to the second end of the pivot rod;

wherein the engagement part has a hook-shaped configuration;

wherein each of the fixed portions of the pivot rod has a concave arc structure with inward curve;

wherein a convex arc portion is connected between an adjacent two said fixed portions of the pivot rod;

wherein an outer diameter of the section of the pivot rod adjacent the first end is slightly larger than or equal to an inside diameter of the holes of the connecting bar.

2. The pop-up drain stopper linkage assembly according to claim 1, wherein the engagement part has a substantially rectangular cross-section.

* * * * *